US006209304B1

(12) United States Patent
Feuerlohn et al.

(10) Patent No.: US 6,209,304 B1
(45) Date of Patent: Apr. 3, 2001

(54) SPINNING DEVICE

(75) Inventors: Helmut Feuerlohn, Mönchengladbach (DE); Liberto Coll-Tortosa, Terassa/Barcelona; Frances Roig Munill, Sabadell, both of (ES); Thomas Weide, Mönchengladbach (DE); Jose Antonio Tomero-Garcia, St. Salvador de guardiol (ES); Oliver Schulze, Schwalmtal (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/411,882

(22) Filed: Oct. 4, 1999

(30) Foreign Application Priority Data

Oct. 2, 1998 (DE) ..... 198 45 460
Jun. 10, 1999 (DE) ..... 199 26 492

(51) Int. Cl.[7] ..... D01H 1/00; D01H 1/115; D01H 7/00; D02G 3/34

(52) U.S. Cl. ..... 57/328; 19/35 A; 19/228; 28/252; 57/261; 57/296; 57/328; 57/333; 226/7; 226/97.4; 226/196.1

(58) Field of Search ..... 19/65 A, 228; 57/261, 296, 328, 353; 28/252; 226/7, 97.4, 196.1

(56) References Cited

FOREIGN PATENT DOCUMENTS

| | | |
|---|---|---|
| 502 452 | 12/1968 | (CH) . |
| 37 25 168 A1 | 7/1987 | (DE) . |
| 37 31 854 A1 | 9/1987 | (DE) . |
| 40 36 119 C2 | 11/1990 | (DE) . |
| 44 31 761 C2 | 9/1994 | (DE) . |

*Primary Examiner*—John J. Calvert
*Assistant Examiner*—Shaun R Hurley
(74) *Attorney, Agent, or Firm*—Kennedy Covington Lobdell & Hickman, L.L.P.

(57) ABSTRACT

A device for producing spun yarn by means of an airflow acting in the area between a sliver guide and a spindle (13) on fibers of a non-twisted sliver (10) drafted and delivered by a drafting arrangement in order to twist the fibers. Thereafter, the sliver (10) is passed through the spindle (13). Outside of an imaginary center line (9) of the traveling sliver (10), the sliver guide is arranged such that the fibers are passed along the inward lying surface of the sliver guide. The sliver guide comprises fiber guide elements (16) spaced apart from each other, which permit the free passage of a core fiber bundle. An improved spinning process, along with high productivity and increased yarn strength is possible by means of the device of the invention. The spinning device can be manufactured and operated cost-effectively.

19 Claims, 9 Drawing Sheets

SPINNING DEVICE

FIELD OF THE INVENTION

The present invention relates to a spinning device and, more particularly, to a spinning device with an inlet opening for a drafted sliver, a sliver guide and a hollow spindle for guiding the formed and drawn-off yarn, wherein means for generating an airflow are provided in the area of the sliver guide and the spindle, which acts on the fibers of the drafted sliver for twisting them.

BACKGROUND OF THE INVENTION

A device for producing a twisted yarn is known from German Patent Publication DE 40 36 119, wherein a guide member is arranged inside a nozzle block. A sliver traveling out of a drafting arrangement is drawn into the nozzle block and, near the inlet opening of a spindle, is subjected to an airflow rotating around the sliver for twisting it in this manner. A fiber strand guide takes the place of the inner fibers of the sliver as a so-called false core, because of which the fibers on the exterior circumferential surface of the fiber strand guide are forced to move along toward the inlet opening. In the course of this, the fibers are subjected to the action of the rotating airflow in an uncontrolled manner. Only the fiber strand guide arranged in the interior of the sliver counters an interfering false twist running out of the rotating area of the spindle in the direction toward the location where the sliver exits between the front rollers of the drafting arrangement. Subsequently the sliver is aspirated into the spindle by means of a suction airflow in order to create a yarn in this way.

Continuously increasing demands in regard to productivity and yarn properties are made on modern spinning machines.

SUMMARY OF THE INVENTION

It is therefore an object of the present invention to improve the device for sliver guidance in the type of spinning device described above in such a manner that an improved manufacturing process becomes possible.

In accordance with the invention, the sliver guide is comprised of fiber guide elements, which are spaced apart from each other and permit the free passage of a portion of the fibers constituting a core fiber bundle and the sliver guide is arranged outside of an imaginary center line of the traveling sliver such that at least a portion of the fibers is passed along the inward surface of the sliver guide. The spinning device can be designed such that the core fiber bundle is not deflected in the course of the passage of the sliver through the sliver guide. It is possible to achieve high production speeds with such an embodiment. Advantageously, the core fiber bundle includes at least 10%, preferably 20% to 40%, of the fibers. A good grasp and good guidance of the sliver between the fiber guide elements is achieved by means of the inner surface of the fiber guide elements, which is in contact with the sliver. In this manner, it is possible to divide the portions of the core and the sheath structures in a controlled manner into fibers which are oriented parallel in the longitudinal direction and into twisted fibers, wherein the core fibers only constitute a defined portion. The uncontrolled spreading away of fibers and fiber ends, as well as the continuation of the twisting in the direction toward the outlet of the sliver between the front rollers of the drafting arrangement is effectively prevented.

It is possible to improve the arrangement of the fibers which are oriented parallel in the longitudinal direction, and thereby the yarn properties, by means of yarn guide elements forming the core yarn bundle. An increase of the production speed is made possible at the same time.

In a further advantageous aspect of the invention, at least a portion of the fiber guide elements is embodied as a flat plate, by means of which it is possible to achieve a greater effect on the sliver. Alternatively, at least a portion of the fiber guide elements is preferably embodied to be needle-shaped. This permits the application of a particularly low pressure on the sliver. Fiber guide elements produced as flat plates or as needle-shaped can be easily manufactured. An embodiment of the fiber guide elements as parts of a single body, in which the fiber guide elements are made by cutting openings into a hollow cone, can also be simply and therefore cost-effectively produced and permits an improvement in the yarn values, particularly at high production speeds. The cutting of openings can be performed by erosion or drilling.

The embodiment can also be in the form of a compact sliver guide device with a sliver passage and fiber guide elements, wherein the sliver guide device is made of one piece. Simple handling and an easy and fast exchangeability are made possible because of the compact, one-piece design.

In a preferred embodiment, the fiber guide elements are arranged evenly distributed around the sliver, in particular concentrically or symmetrically, and the minimum distance of the fiber guide elements from the imaginary center line of the traveling sliver is slightly less than half the diameter of the sliver. Advantageously at least three fiber guide elements act on a single sliver. Such arrangements permit a specific metering or an increase of the guide and holding effects. The fiber guide elements preferably have the same shape in order to achieve as uniform an effect as possible distributed over the circumference of the sliver.

The inlet opening is preferably embodied as a slit-shaped sliver passage at least at the outlet side of the sliver, on whose oppositely located longitudinal sides the fiber guide elements are arranged, wherein the fiber guide elements extend at least approximately parallel in relation to the imaginary center line of the sliver, so that they cover a portion of the fiber flow from the sliver passage to approximately the vicinity of the inlet opening of the spindle and therefore remove it to the greatest possible extent from the effect of the rotating airflow. The retention of a core fiber bundle with primarily parallel and longitudinally oriented fibers in a largely undisturbed arrangement is made possible in this manner. By means of the spinning device in accordance with the invention, it is possible to achieve yarn speeds of 300 m/min and more, and therefore high productivity. Increased yarn strength and therefore an increased value of the finished yarn is also possible. A lower value can be selected for the pressure of the compressed air provided by the compressed air source. With the multitude of spinning stations in a modern spinning machine, a reduced air pressure leads to considerable cost reduction in the yarn production.

The fiber guide elements advantageously follow in the fiber flow direction immediately after the sliver passage and are arranged to be respectively centered on the longitudinal sides of the sliver passage, as viewed across the width of the sliver passage. The inside surfaces of the fiber guide elements facing the sliver extend in the direction of the fiber flow or in the direction of the respective free end of the fiber guide elements toward the center of the sliver, and the fiber guide elements have their smallest distance from each other at their free ends, by means of which the insertion of the sliver is made easier and the guidance of the passing sliver is improved.

The fiber guide elements are preferably designed resiliently such that, in case of an increase of the pressure exerted by the sliver on the inner surfaces of the fiber guide elements, they can be deflected transversely in relation to their extension. The free ends of the fiber guide elements oriented in the direction of movement preferably extend toward each other and have their smallest distance from each other at their free ends, but without touching each other. Advantageously, the fiber guide elements are designed such that their cross section increases toward the free ends. In this case, the core fiber bundle can extend centered on the imaginary axis of the device, and the imaginary center line of the sliver and the axis of the device can coincide. The insertion and the passage of the sliver is made easier by such an embodiment, and the guidance of the passing sliver is improved.

The position of the fiber guide elements is preferably adjustable and can be selected in accordance with the requirements of the spinning operation being performed. In particular, the distance between the free ends of the fiber guide elements and the inlet opening of the spindle is 0.2 mm to 0.7 mm. In this manner, a definite control, both of the effect and also the effective range, becomes possible in a particularly simple manner. The yarn formation can be advantageously affected and varied by means of such an embodiment and change of the position of the fiber guide elements.

By means of the device in accordance with the invention, high productivity is possible at high yarn speeds of more than 300 m/min and with increased yarn strength. The spinning device can be cost-effectively manufactured and operated.

Further details, features and advantages of the present invention will be understood from exemplary embodiments described in following specification with reference to the accompanying drawings.

DETAILED DESCRIPTION OF THE PREFERRED EMBODIMENTS

Figure 1:
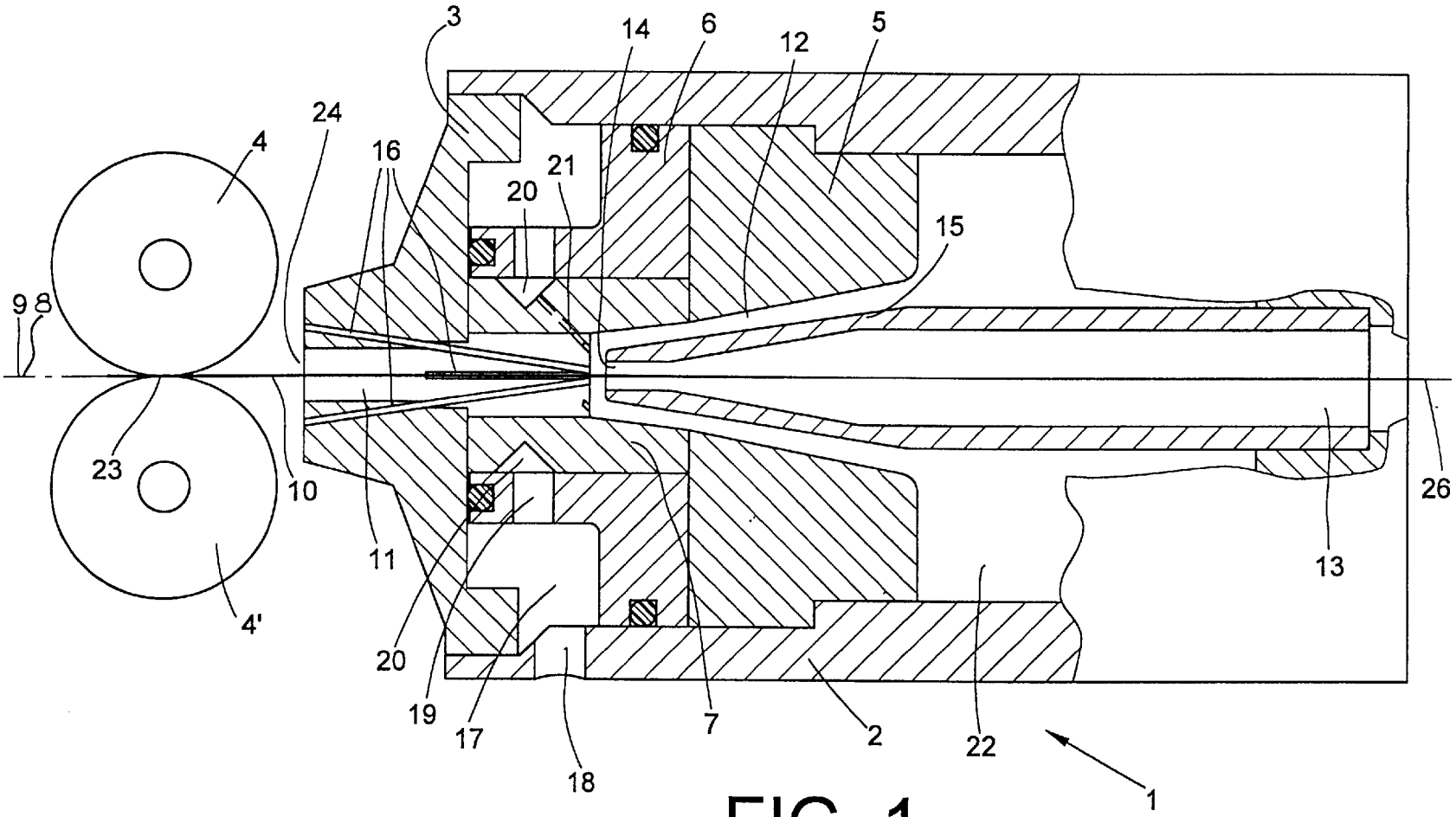
FIG. 1 is a schematic representation of a spinning device in accordance with the present invention depicted in a longitudinal section.

The spinning station 1 represented in FIG. 1 has a housing 2, at the end of which a disk 3 is arranged, facing two front rollers 4, 4' of a drafting arrangement. A nozzle device 7, maintained by a holding ring 6, is disposed around an axis 8 in the interior of the housing 2 between the disk 3 and a receiving body 5. In the representation of FIG. 1, the axis 8 coincides with the center line 9 of the passing sliver 10. A sliver passage 11 leads from the inlet side of the housing 2 along the center line 9 through the center of the disk 3. From the sliver passage 11, a transition takes place through a widening conical area into an area within the nozzle device 7 and the receiving body 5 which is initially cylindrical and then also conically widens. A hollow spindle 13 with a spindle head 15, which conically tapers in the direction toward the spindle inlet opening 14, projects in the conically designed hollow space 12 of the receiving body 5 and the nozzle device 7. A ring-shaped portion of the hollow space 12 remains between the spindle 13 and the nozzle device 7, as well as the receiving body 5.

A fiber guide, formed by fiber guide elements 16, is fastened on the disk 3, with the fiber guide elements 16 extending obliquely inwardly inclined in relation to the fiber movement direction toward the center line 9. An air chamber 17 is located between the housing 2 and the holding ring 6. Toward the outside, the air chamber 17 is connected via a bore 18 with an air source, not represented for reasons of simplicity, and toward the inside the air chamber 17 is connected via further bores 19 with a ring-shaped air channel 20. The nozzle device 7 is provided with four air nozzles 21, which connect the air channel 20 with the sliver passage 11 and at the outlet into the sliver passage 11 are directed in a tangential orientation toward an area located between the fiber guide elements 16 and the spindle inlet opening 14. The compressed air supplied by the air source flows via the air chamber 17 into the ring-shaped air channel 20, is subsequently expelled out of the air nozzles 21, and in this manner generates an airflow, which rotates at high speed around the sliver 10 directly at the spindle inlet opening. After the rotating passage of the ring-shaped portion of the hollow space 12, this airflow is conducted into the chamber 22 and further to an opening, also not represented, in the housing 2, through which it exits. At the same time, the airflow generates a suction airflow, which moves along with the sliver 10, exiting at a nip location 23 between the front rollers 4, 4', through the inlet opening 24 and the sliver passage 11 into the hollow space 12, and which is continued by a suction air flow generated by a vacuum source, not represented.

The sliver 10, which is drafted in the drafting arrangement, is fed by the front rollers 4, 4' to the spinning station 1 and, assisted by the suction airflow effective upstream of the guide channel, is drawn into the central inlet opening 24 of the disk 3 and therefrom into the sliver passage 11. The inclination of the fiber guide elements 16, which are embodied in a needle shape, is directed inwardly in the direction toward the axis 8 and toward the sliver 10, and makes the insertion and guidance of the traveling sliver 10 easier.

Figure 2:
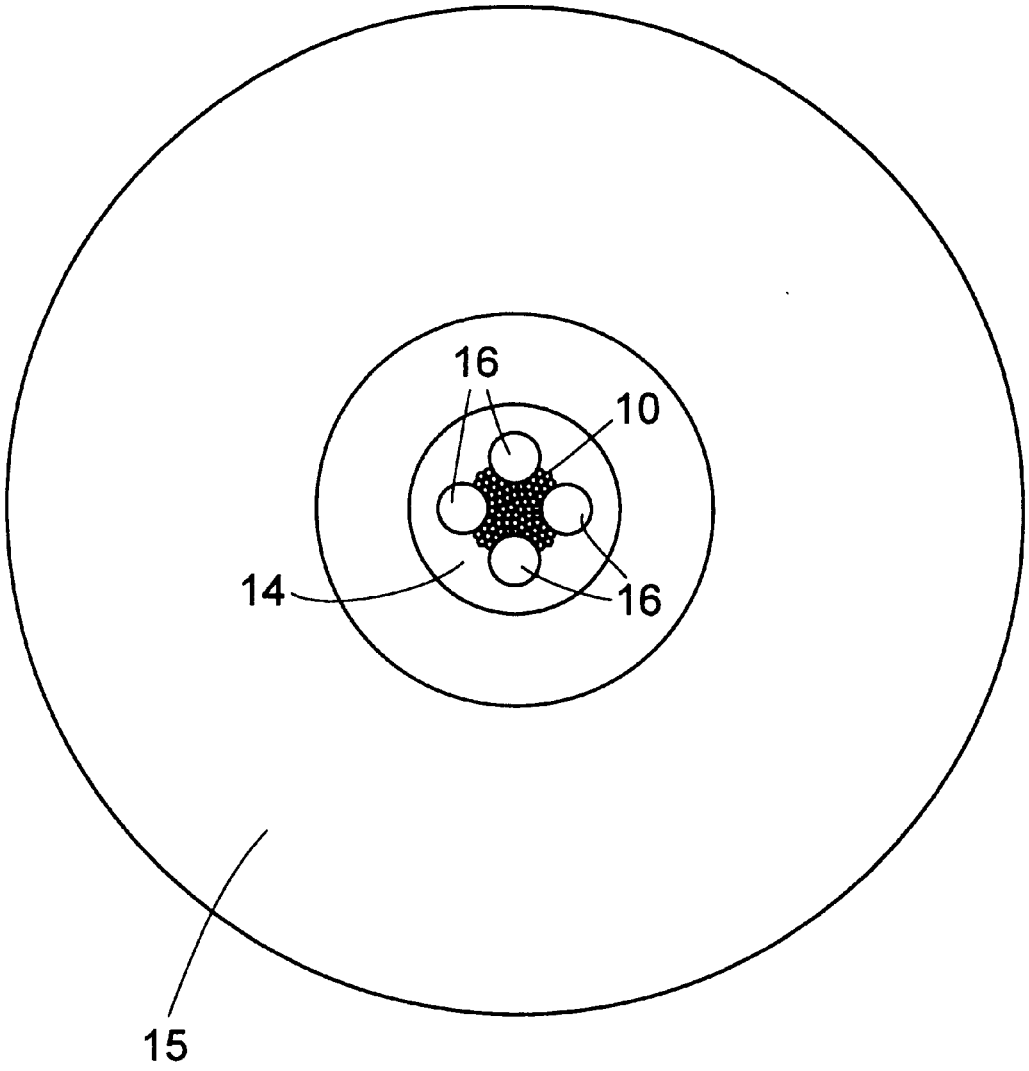
FIG. 2 is a plan view of the spindle head of the spinning device of FIG. 1 viewed in the longitudinal direction.

Further details can be understood from FIGS. 2 to 5. The fiber guide elements 16 can exert a slight pressure on the sliver 10, which in this case is slightly deformed, as represented in FIG. 2. By means of this guidance of the sliver 10, which acts in a sort of interlocking manner, the propagation of twisting in the sliver 10 past the area located between the guide elements 16 and the spindle inlet openings 14 in the direction toward the front rollers 4, 4' of the drafting arrangement is effectively stopped.

Figure 3:
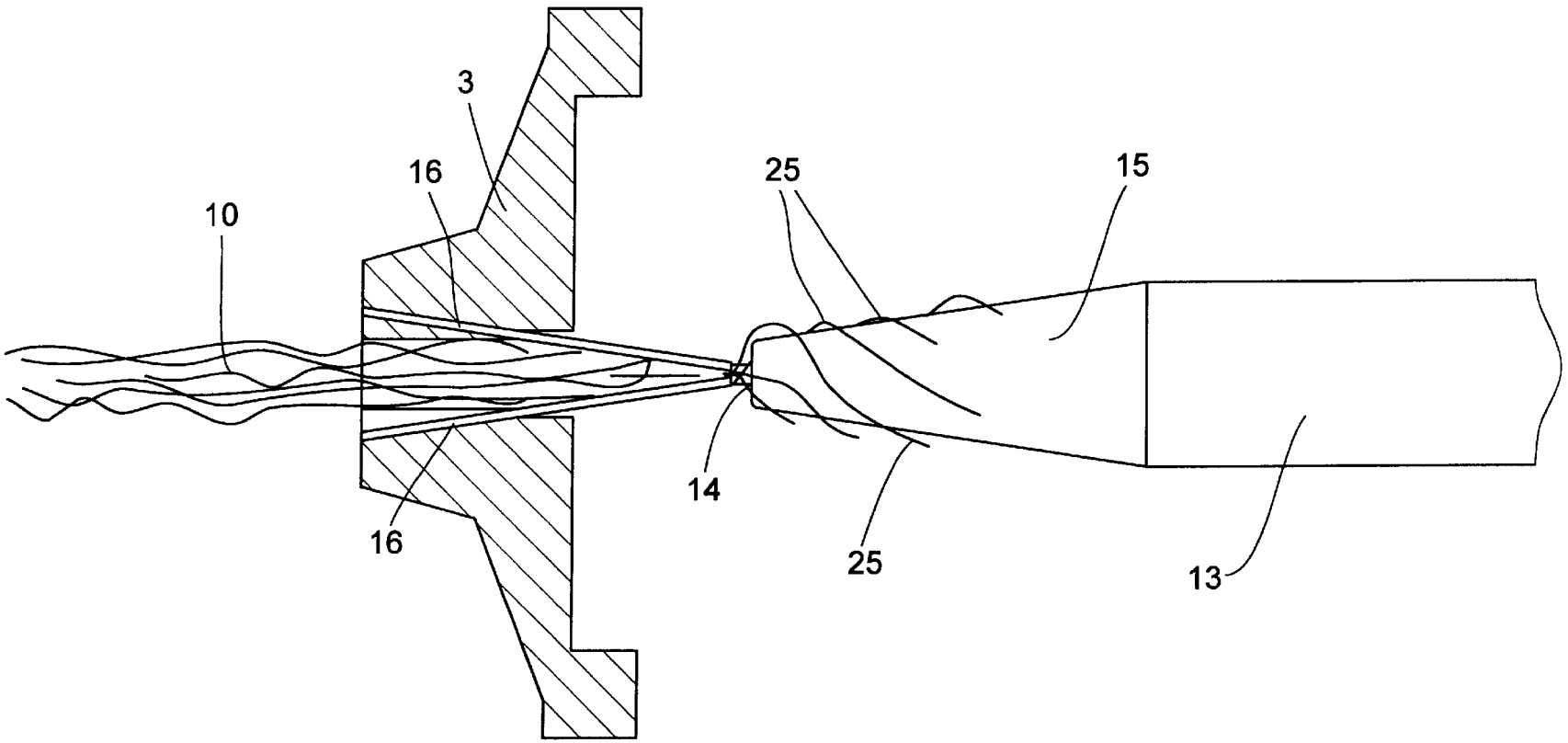
FIG. 3 is a partial view of the spinning process of the spinning device of FIG. 1 viewed in the area of the fiber guide elements and the spindle head.

If the rear end of a fiber 25 in the area of the airflow rotating around the moving sliver 10 moves outside of the covering effect of the fiber guide element 16, it is fully exposed to the force of the airflow coming out of the air nozzles 21 and is lifted, or respectively released, from the surface of the sliver 10. The other end of the fiber 25 is not released. It is subjected to a rotation and is already inserted into the hollow spindle 13 and in this way removed from the direct effect of the airflow. Released free fiber ends are twisted around the spindle inlet opening 14, as well as the conical spindle head 15, by the rotating airflow and aided by the suction airflow effective in the hollow space 12, as represented in FIG. 3. The twisting can take place in several windings.

Figure 4:
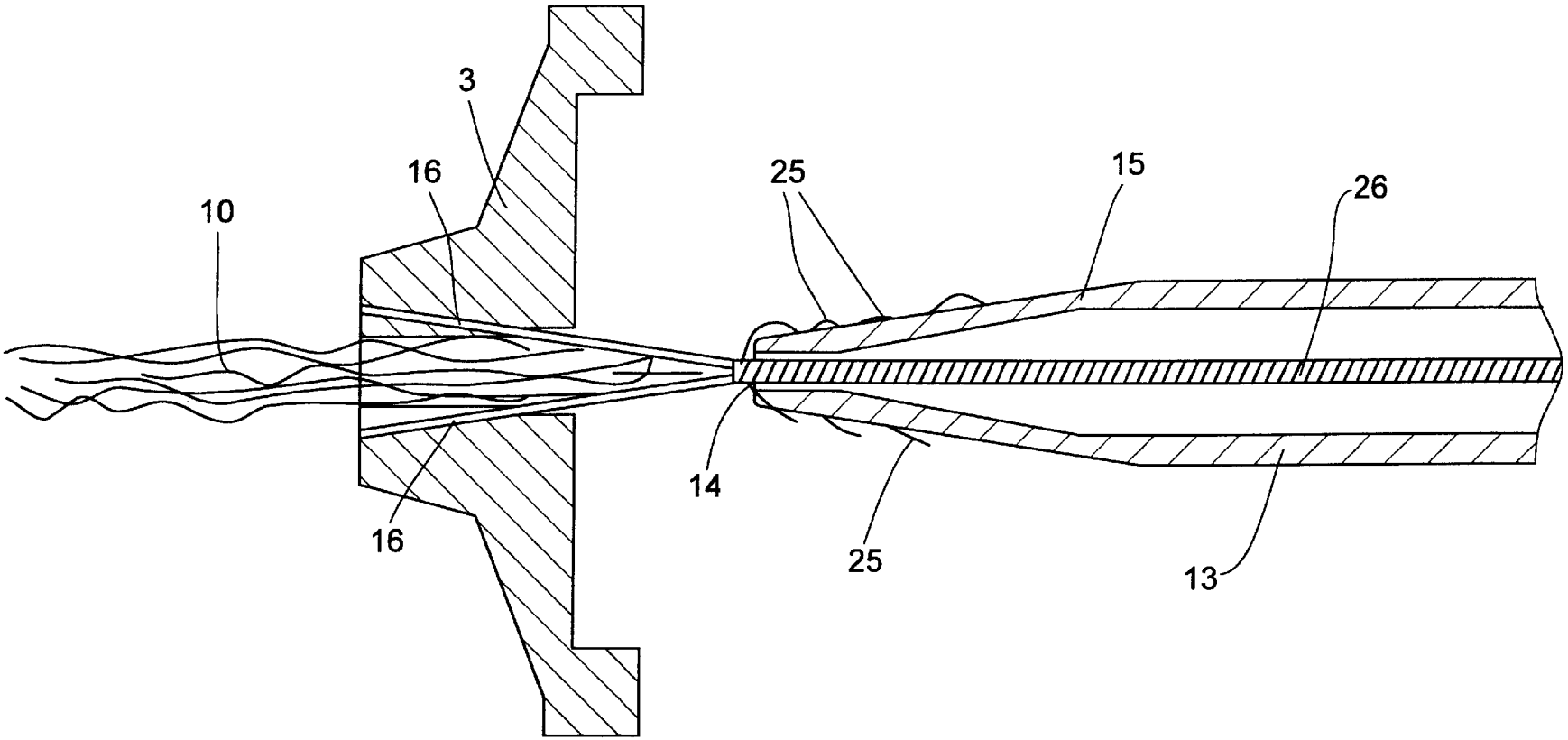
FIG. 4 is another partial view of the spinning process like that of FIG. 3 with the spindle head shown in longitudinal section to illustrate the spun yarn produced.

The rear free ends of the fibers 25 are continuously drawn in by the movements of the sliver 10 which, in the representation in FIGS. 1 and 2, takes place from left to right, and in the process a helical twisting of the sliver 10 takes place because of the free ends. The production principle of such a yarn 26 is illustrated in FIG. 4.

The portions of the core and sheath structures in the cross section of the yarn 26 have been divided in this way into fibers which are oriented parallel in the lengthwise direction and into twisted fibers, wherein the core fibers, which are oriented in the lengthwise direction, only constitute a small part of the yarn 26. True twisting is maintained in the yarn 26.

Figure 5:
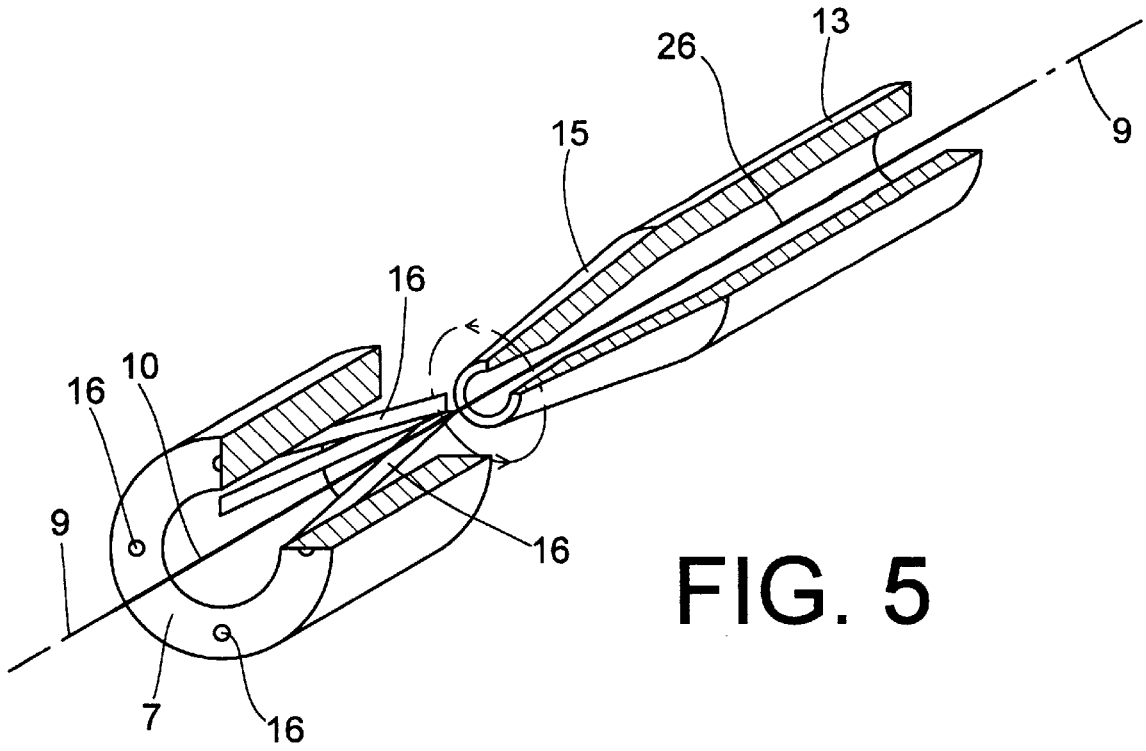
FIG. 5 is a perspective representation of the spindle head and fiber guide elements, partially broken away, depicting the principle of the spinning process.

The principle of the explained spinning process can be seen in a simplified perspective representation in FIG. 5. In the representation in FIG. 5, the path of the sliver 10, and respectively of the spun yarn 26, extends linearly and horizontally and is indicated by the center line 9. After passing through the nozzle device 7 and the fiber guide elements 16, the sliver 10 is subjected to the effects of the airflow, which is directed in the direction of the broken line arrow, and it is drawn off as the spun yarn 26 by means of the spindle 13.

Figure 7:
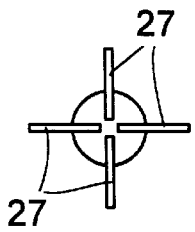
FIG. 7 shows the embodiment in FIG. 6 in an end view as seen in the direction of the arrows of FIG. 6, FIGS. 8 and 9 are schematic representations of further embodiments of the fiber guide elements.
Figure 6:
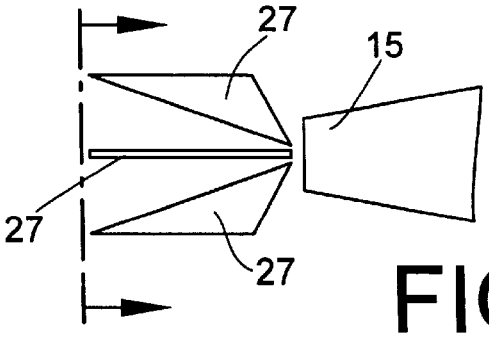
FIG. 6 is a schematic representation of a second embodiment of the fiber guide elements.

FIGS. 6 and 7 show other embodiments of fiber guide elements 27 in the form of triangular plates. The fiber guide elements 27, which are symmetrically arranged around the center line 9, act with their tips facing the center line 9 on the sliver 10, which is not represented in FIGS. 6 and 7.

Figure 8:
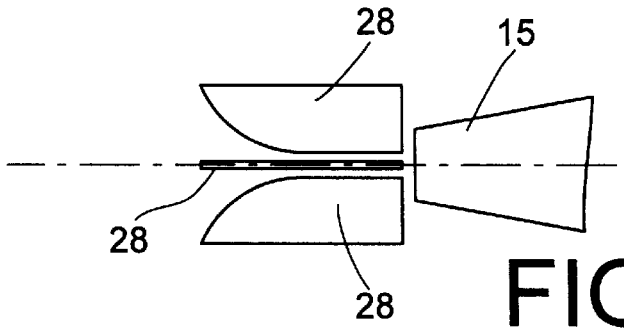

FIG. 8 also shows a plate-shaped design of fiber guide elements 28, wherein the edge of the fiber guide elements 28 facing the center line 9 extends in an arcuate shape toward the center, so that the sliver 10, which is also not represented in FIG. 8, is guided and covered by the fiber guide elements over an area which is longer in comparison to FIG. 6.

Figure 9:
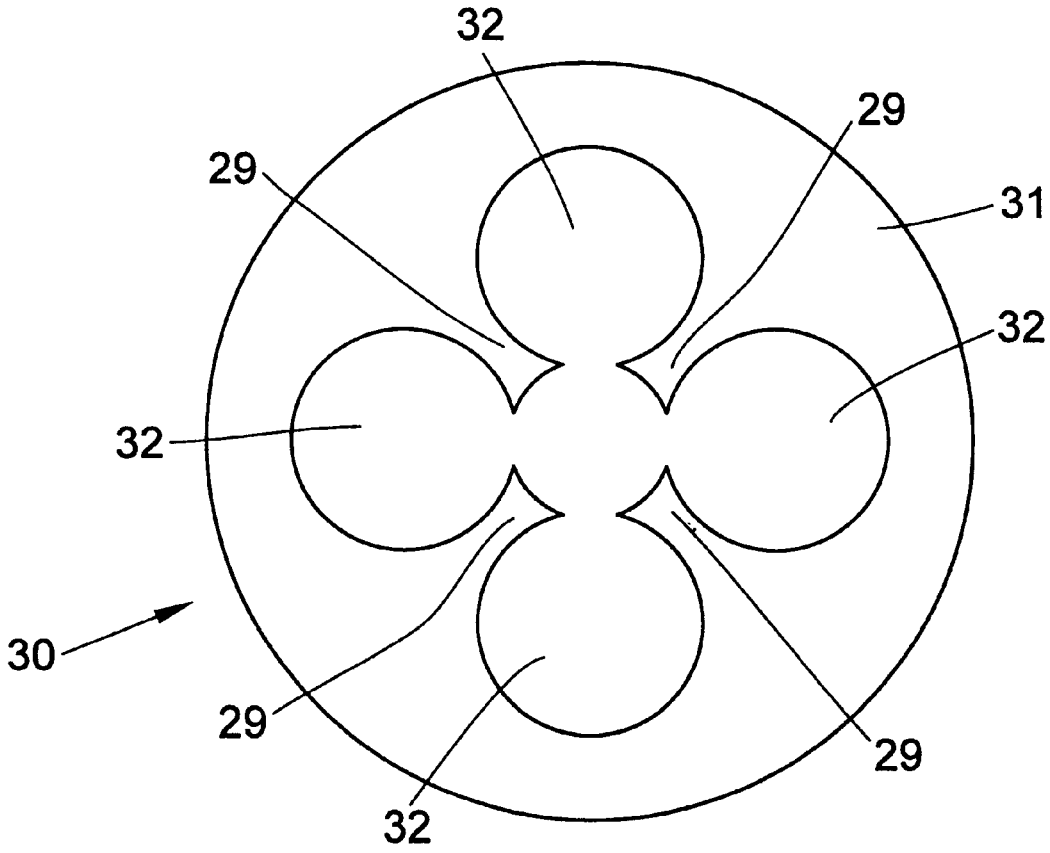

The fiber guide elements 29 represented in FIG. 9 are made of one piece, wherein a hollow body 30 has a sliver guide body 31, as well as the fiber guide elements 29, which are formed by cutting openings 32. Cutting the openings 32 can take place in a simple manner by erosion or drilling, for example. The fiber guide elements 29 widen in the direction toward their free ends, which extend toward the axis of rotation of the hollow body 30. In this way, the fiber guide elements 29 form and guide the sliver, not shown, moving along the axis of rotation of the hollow body 30, in a particularly effective manner.

Figure 10:
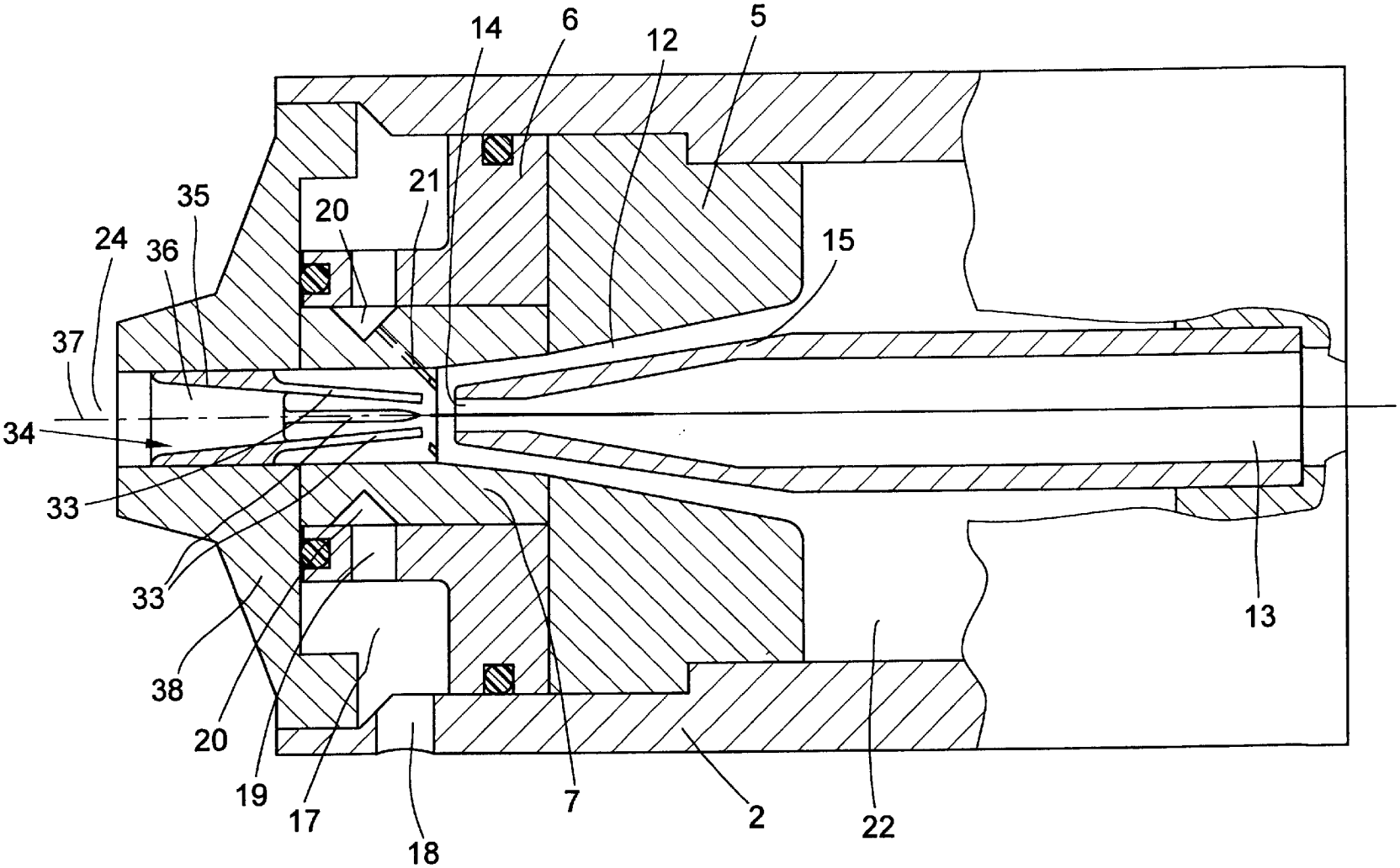
FIG. 10 is a view in longitudinal section of a spinning device of the invention having fiber guide elements which constitute a unit together with a fiber guide body.

A sliver guide is shown in FIG. 10, whose fiber guide elements 33 are also a part of a single hollow body 34, corresponding to the embodiment represented in FIG. 9. The partially conically embodied hollow body 34 comprises a sliver guide body 35 with a sliver passage 36, as well as fiber guide elements 33, which are arranged concentrically around the axis of rotation 37 of the hollow body 34 and whose free ends extend toward the axis of rotation 37. The sliver guide represented in FIG. 10 is integrated into a spinning station which to a large extent corresponds to the embodiment of the spinning station 1 represented in FIG. 1 and already extensively described. The spinning station represented in FIG. 10 has a disk 38, which maintains the sliver guide bodies 35 in a centered position.

Figure 11:
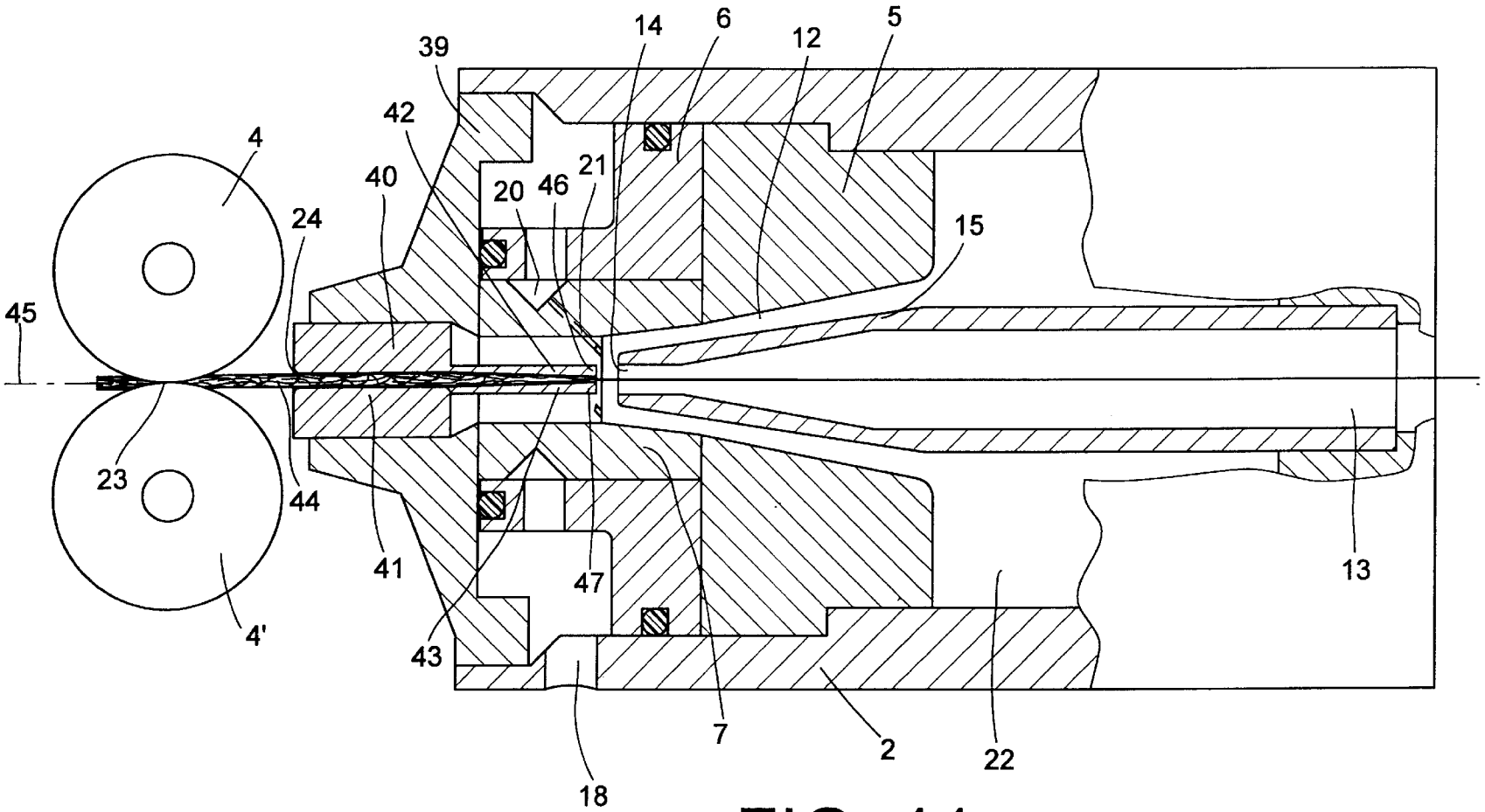
FIG. 11 is another longitudinal sectional view of a spinning device of the invention schematically showing an embodiment of a sliver guide with a slit-shaped sliver passage.

The spinning device in FIG. 11 also corresponds to a large degree to the already described spinning devices in FIGS. 1 to 10. However, the disk 39 holds an alternative embodiment of the sliver guide. The sliver guide body 40 surrounds a slit-shaped sliver passage 41. The fiber guide elements 42, 43, which follow the sliver passage 41 in the direction of the fiber travel and constitute a unit with the sliver guide body 40, are arranged on the lengthwise sides of the slit-shaped sliver passage 41 such that the fiber guide element 42 acts from above on the center of the passing sliver 44, and the fiber guide element 43, which lies opposite the fiber guide element 42, acts on the center of the underside of the sliver 44 with a guiding effect, with the surface of the sliver 44 being partially covered. The inward facing surfaces of the fiber guide elements 42, 43, which respectively come into contact with the sliver 44, extend inclined slightly obliquely inwardly relative to the fiber flow direction and toward the center line 45 of the sliver 44 without reaching it. The surfaces of the portions of the fiber guide elements 42, 43, which directly adjoin the sliver guide body 40 and are inwardly oriented toward the sliver 44, are spaced a slightly larger distance from the center line 45 in comparison to the surfaces of the fiber guide elements 42, 43 located at the free ends 46, 47 in the fiber flow direction, which makes sliver insertion easier and improves the guidance of the passing sliver 44.

Figure 12:
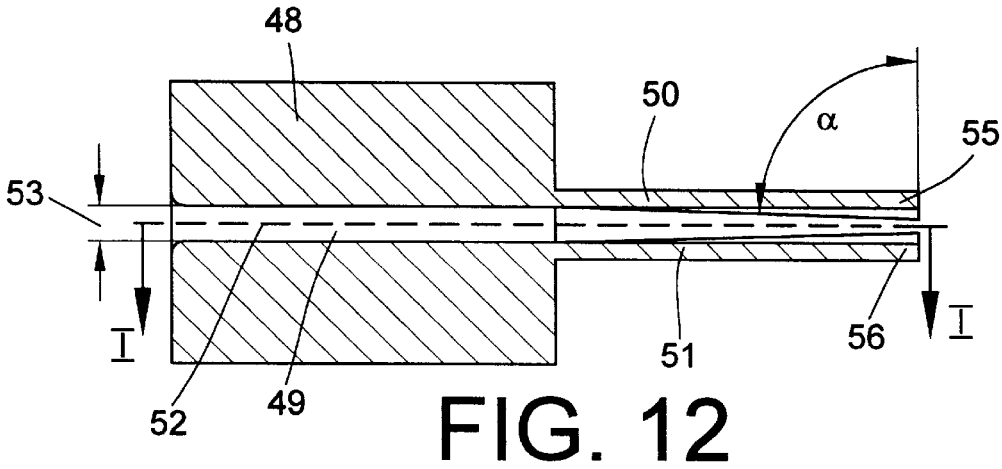
FIG. 12 is an enlarged view of the fiber guide elements of the embodiment in accordance with FIG. 11, shown in longitudinal section.
Figure 13:
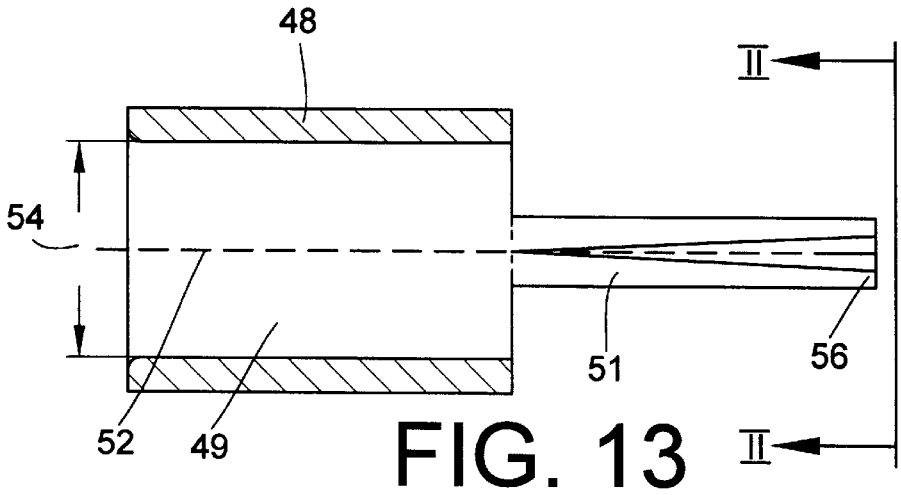
FIG. 13 is another enlarged cross sectional view of the fiber guide elements of the embodiment of FIG. 11 taken along section line I—I thereof.
Figure 14:
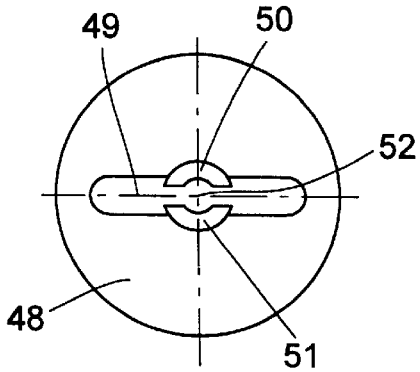
FIG. 14 is a plan view of the embodiment of the fiber guide elements of FIG. 13 in a plan view as seen along line II—II thereof.

A further alternative embodiment can be understood from FIGS. 12 to 14. These drawing figures show different plan views of a sliver guide body 48 with a sliver passage 49, wherein the sliver guide body 48, together with two fiber guide elements 50, 51, form a unit made in one piece. The surfaces of the fiber guide elements 50, 52, which respectively lie toward the imaginary center line 52 of the sliver, not represented, extend slightly obliquely toward the interior inclined toward the fiber flow direction and toward the center line 52 without reaching it, with the angle being approximately 89 degrees. The sliver passage is designed in the shape of a slit with a height 53 of, for example, about 0.6 mm and a width 54 of, for example, about 3.6 mm. During the operation of the spinning process, the cross section of the sliver passage 49 is filled by the passing sliver. At the rear end of the sliver guide body 48, as viewed in the fiber flow direction, fiber guide elements 50, 51 are centrally connected respectively at the upper and lower end edges of the longitudinal side of the slit-shaped sliver passage 49. The ends 55, 56 of the fiber guide elements 50, 51 are embodied to be concave in the direction toward the center line 52.

The invention is of course not limited to the represented exemplary embodiments. For example, besides the represented fixed embodiment, the spindle 13 can also be designed to be rotatable. The direction of turning of the spindle 13 and the discharge direction of the nozzles 21 cause the sheath direction of the fibers. For an undisturbed sheath direction of the sheath of fiber ends, the direction of turning of the spindle 13 and the discharge direction of the air nozzles 21 preferably coincide. The center line 9 of the sliver 10 need not lie continuously flush on the extension of the axis 8 of the spindle 13, but in parts can for example extend at an acute angle in relation to the axis 8.

The drive and the seating of device elements, as well as the control and linkage with upstream or downstream units, to the extent not described in detail herein, can be accomplished in a manner known per se.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto.

What is claimed is:

1. A spinning device comprising an inlet opening for receiving a drafted sliver (10, 14), a sliver guide, a hollow spindle (13) for guiding a yarn (26) formed from the sliver, and means for generating an airflow in the area of the sliver guide and the spindle (13) for twisting the fibers of the drafted sliver (10, 14), wherein the sliver guide is arranged outward of an imaginary center line (9, 45, 52) of the traveling sliver (10, 14) such that at least a portion of the fibers of the sliver (10, 14) passes along an inward facing surface of the sliver guide, and wherein the sliver guide comprises fiber guide elements (16, 27, 28, 29, 33, 42, 43, 50, 51), which are spaced apart from each other and permit the free passage of a core fiber bundle.

2. The device in accordance with claim 1, characterized in that the core fiber bundle comprises at least about 10% of the fibers.

3. The device in accordance with claim 1, characterized in that the core fiber bundle comprises at least about 20% to about 40% of the fibers.

4. The device in accordance with claim 1, characterized in that at least some of the fiber guide elements (29, 50, 51) are embodied such that they form the core fiber bundle.

5. The device in accordance with claim 1, characterized in that at least a portion of the fiber guide elements (27, 28, 42, 43) is embodied as a flat plate.

6. The device in accordance with claim 1, characterized in that at least a portion of the fiber guide elements (16) is embodied in a needle-shape.

7. The device in accordance with claim 1, characterized in that the fiber guide elements (33) constitute parts of a single body comprising a hollow cone having openings formed therein to form the fiber guide elements (33).

8. The device in accordance with claim 1, characterized in that the fiber guide elements (16, 27, 28, 29, 33, 42, 43, 50, 51) are uniformly distributed around the sliver (10, 14), and the minimum distance of the fiber guide elements (16, 27, 28, 29, 33, 42, 43, 50, 51) from the imaginary center line (9, 45, 52) of the traveling sliver (10, 44) is slightly less than half the diameter of the sliver (10, 44).

9. The device in accordance with claim 8, characterized in that the fiber guide elements (16, 27, 28, 29, 33, 42, 43, 50, 51) are concentrically distributed around the sliver (10, 14).

10. The device in accordance with claim 8, characterized in that the fiber guide elements (16, 27, 28, 29, 33, 42, 43, 50, 51) are symmetrically distributed around the sliver (10,14).

11. The device in accordance with claim 1, characterized in that the sliver guide has at least three fiber guide elements (16, 27, 28), which act on a single sliver (10).

12. The device in accordance with claim 1, characterized in that the inlet opening comprises a sliver passage (41, 49) forming a slit at least at an outlet for the sliver (44), with the fiber guide elements (42, 43, 50, 51) being arranged on opposite longitudinal sides of the slit and extending at least approximately parallel in relation to the imaginary center line (45, 52) of the sliver (44) to cover a portion of the fiber flow from the sliver passage (41, 49) to approximately the vicinity of the inlet opening (14) of the spindle (13), thereby to essentially remove the spindle (13) from the effect of the rotating airflow.

13. The device in accordance with claim 12, characterized in that the fiber guide elements (42, 43, 50, 51) follow in the fiber flow direction immediately after the sliver passage (41, 49) and are arranged, as viewed across the width (54) of the sliver passage (41, 49), respectively centered on the longitudinal sides of the sliver passage (41. 49).

14. The device in accordance with claim 1, characterized in that the fiber guide elements (16, 27, 28, 29, 33, 42, 43, 50, 51) have the same shape.

15. The device in accordance with claim 1, characterized in that the fiber guide elements (16, 27, 28, 29, 33, 42, 43, 50, 51) respectively have at least one free end (46, 47, 55, 56) extending in the fiber flow direction with an inside surface facing the sliver (10, 44) in the fiber flow direction toward the center of the sliver (10, 44), and with the smallest distance of the fiber guide elements (16, 27, 28, 29, 33, 42, 43, 50, 51) from each other at their free ends (46, 47, 55, 56).

16. The device in accordance with claim 1, characterized in that the fiber guide elements (16, 27, 28, 29, 33, 42, 43, 50, 51) are resilient to be deflectable transversely in relation to their lengthwise extent in case of an increase of the pressure exerted by the sliver (10, 44) on the inner surfaces of the fiber guide elements (16, 27, 28, 29, 33, 42, 43, 50, 51).

17. The device in accordance with claim 1, characterized in that a cross sectional dimension of the fiber guide elements (29) increases toward the free ends thereof.

18. The device in accordance with claim 1, characterized in that the distance between the free ends of the fiber guide elements (16, 27, 28, 29, 33, 42, 43, 50, 51) and the inlet opening (14) of the spindle (13) is about 0.2 mm to about 0.7 mm.

19. The device in accordance with claim 1, characterized in that the fiber guide elements (16, 27, 28, 29, 33, 42, 43, 50, 51) have means for adjusting their positions.

* * * * *